US007182334B2

(12) United States Patent
Spence et al.

(10) Patent No.: US 7,182,334 B2
(45) Date of Patent: Feb. 27, 2007

(54) AIR DIFFUSING VACUUM TRANSPORT BELT

(75) Inventors: James J. Spence, Honeoye Falls, NY (US); Steven M. Russel, Pittsford, NY (US); Donald M. Bott, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 300 days.

(21) Appl. No.: 10/719,396

(22) Filed: Nov. 21, 2003

(65) Prior Publication Data

US 2005/0147454 A1 Jul. 7, 2005

(51) Int. Cl.
*B65H 29/32* (2006.01)

(52) U.S. Cl. ..... 271/197; 271/276; 399/400

(58) Field of Classification Search ..... 271/194, 271/197, 69, 276, 275, 277, 314, 198; 399/400, 399/397, 322

See application file for complete search history.

(56) References Cited

U.S. PATENT DOCUMENTS

| | | | | | |
|---|---|---|---|---|---|
| 3,399,111 | A | | 8/1968 | Beaumont et al. | |
| 3,477,558 | A | * | 11/1969 | Fleischauer | 198/689.1 |
| 4,006,546 | A | * | 2/1977 | Anderson et al. | 40/573 |
| 4,636,803 | A | | 1/1987 | Mikalsen | |
| 5,032,875 | A | * | 7/1991 | Gooray et al. | 399/328 |
| 5,158,846 | A | * | 10/1992 | Bujese | 430/47 |
| 5,461,467 | A | | 10/1995 | Malachowski | |
| 5,535,997 | A | * | 7/1996 | Croyle et al. | 271/12 |
| 5,548,388 | A | | 8/1996 | Schieck | 355/309 |
| 6,086,200 | A | | 7/2000 | Wang-Lee | |
| 6,319,310 | B1 | | 11/2001 | Wong et al. | |
| 6,397,488 | B1 | * | 6/2002 | Brinkly | 34/92 |
| 6,582,072 | B1 | | 6/2003 | Wotton et al. | |
| 2003/0094273 | A1 | * | 5/2003 | Toth et al. | 165/183 |
| 2005/0130023 | A1 | * | 6/2005 | Lebowitz et al. | 429/41 |

FOREIGN PATENT DOCUMENTS

| | | | |
|---|---|---|---|
| EP | 0776846 | | 6/1997 |
| JP | 4-104264 | * | 4/1992 |
| WO | WO 2004/038093 | | 5/2004 |

* cited by examiner

*Primary Examiner*—Patrick Mackey
*Assistant Examiner*—Thomas Morrison
(74) *Attorney, Agent, or Firm*—Tallam I. Nguti

(57) ABSTRACT

An air diffusing vacuum transport belt including a first perforated layer and a second non-perforated layer is provided for transporting image carrying substrates without vacuum belt induced image defects. The first perforated layer includes a top surface and a bottom surface, solid areas, and perforated hole areas interspersing the solid areas for directing pressurized airflow from the top surface through to the bottom surface. The air diffusing vacuum transport belt also includes a second non-perforated layer formed over the top surface of the first perforated layer and covering the solid areas and the perforated hole areas. The second non-perforated layer has an inner surface positioned over the top surface of the first perforated layer, and an outer surface for uniformly supporting substrates. The second non-perforated layer as such is porous to air for diffusing pressurized airflow from the outer surface thereof into the perforated hole areas of the first perforated layer, thereby enabling transporting of image carrying substrates without vacuum belt induced image defects.

13 Claims, 3 Drawing Sheets

AIR DIFFUSING VACUUM TRANSPORT BELT

BACKGROUND AND SUMMARY

The present disclosure relates to copy sheet transport systems, and more particularly, to an air diffusing vacuum transport belt for transporting copy substrates in an image reproducing machine without belt induced image defects.

In image reproducing machines, it is common to transport sheets from one processing station to another, for example from an image transfer station at the photoreceptor to the fuser in a xerographic machine. Typically such sheet transporting uses conventional multi-belt vacuum belt transport systems. Substantial vacuum pressure is applied from a vacuum plenum through holes in each vacuum belt and in a concentrated manner onto an image carrying substrate being transported. Such substantial vacuum pressure usually is desirable in order to provide adequate control over each such substrate or sheet.

High quality color fusing is extremely sensitive to thermal non-uniformity in the sheet prior to fuser entry. Traditional elastomeric belt vacuum transports produce visible gloss differential artifacts on the fused print with as little as 20 degrees F. temperature difference at the paper contact surface. Areas of low thermal transfer (belt holes and areas adjacent to the belt edges) result in lower gloss output since the sheet receives no thermal energy there. Areas of high thermal transfer (belt surface and metal surface between the belts) result in high gloss output since the sheet receives thermal energy there and is essentially preheated. The end result is that the pattern of the belts and holes is noticeable on the print as a differential gloss pattern. In a system with fuser pre-heat, the problems mentioned above are made worse since the temperature differences are greater. Also, with heated sheets, heat transfer can occur in either direction; the sheet can either gain or lose energy to the transport depending on location and temperature differential.

A typical copy sheet vacuum transport assembly that is used to transport copy sheets between a photoreceptor and a fuser of an electrophotographic apparatus is disclosed for example in U.S. Pat. No. 5,548,388 and includes a plurality of belts entrained around a vacuum plenum which pulls each sheet being transported against a plurality of conventional vacuum transport belts and propels each sheet until the hold of the vacuum from the plenum is no longer effective. It has been found that the use of such conventional vacuum transport belts leaves a visible or perceptible gloss difference or defect in images on such sheets or substrates. One primary cause of this defect is a non-uniform temperature gradient on the backside of the sheet or substrate due to differences in heat transfer to/from the solid areas and hole areas in the conventional vacuum transport belts. As a result, the vacuum belt hole pattern can be seen in a glossy image as a defect.

In accordance with the present disclosure, there is provided an air diffusing vacuum transport belt including a first perforated layer and a second non-perforated layer, for transporting image carrying substrates without vacuum belt induced image defects. The first perforated layer includes a top surface and a bottom surface, solid areas, and perforated hole areas interspersing the solid areas for directing pressurized airflow from the top surface through to the bottom surface. The air diffusing vacuum transport belt also includes a second non-perforated layer formed over the top surface of the first perforated layer and covering the solid areas and the perforated hole areas. The second non-perforated layer has an inner surface positioned over the top surface of the first perforated layer, and an outer surface for uniformly supporting substrates. The second non-perforated layer as such is porous to air for diffusing pressurized airflow from the outer surface thereof into the perforated hole areas of the first perforated layer, thereby enabling transporting of image carrying substrates without vacuum belt induced image defects.

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

While the present invention will be described hereinafter in connection with a preferred embodiment thereof, it should be understood that it is not intended to limit the invention to that embodiment. On the contrary, it is intended to cover all alternative, modifications and equivalents as may be included within the spirit and scope of the invention as defined by the appended claims.

Figure 1:
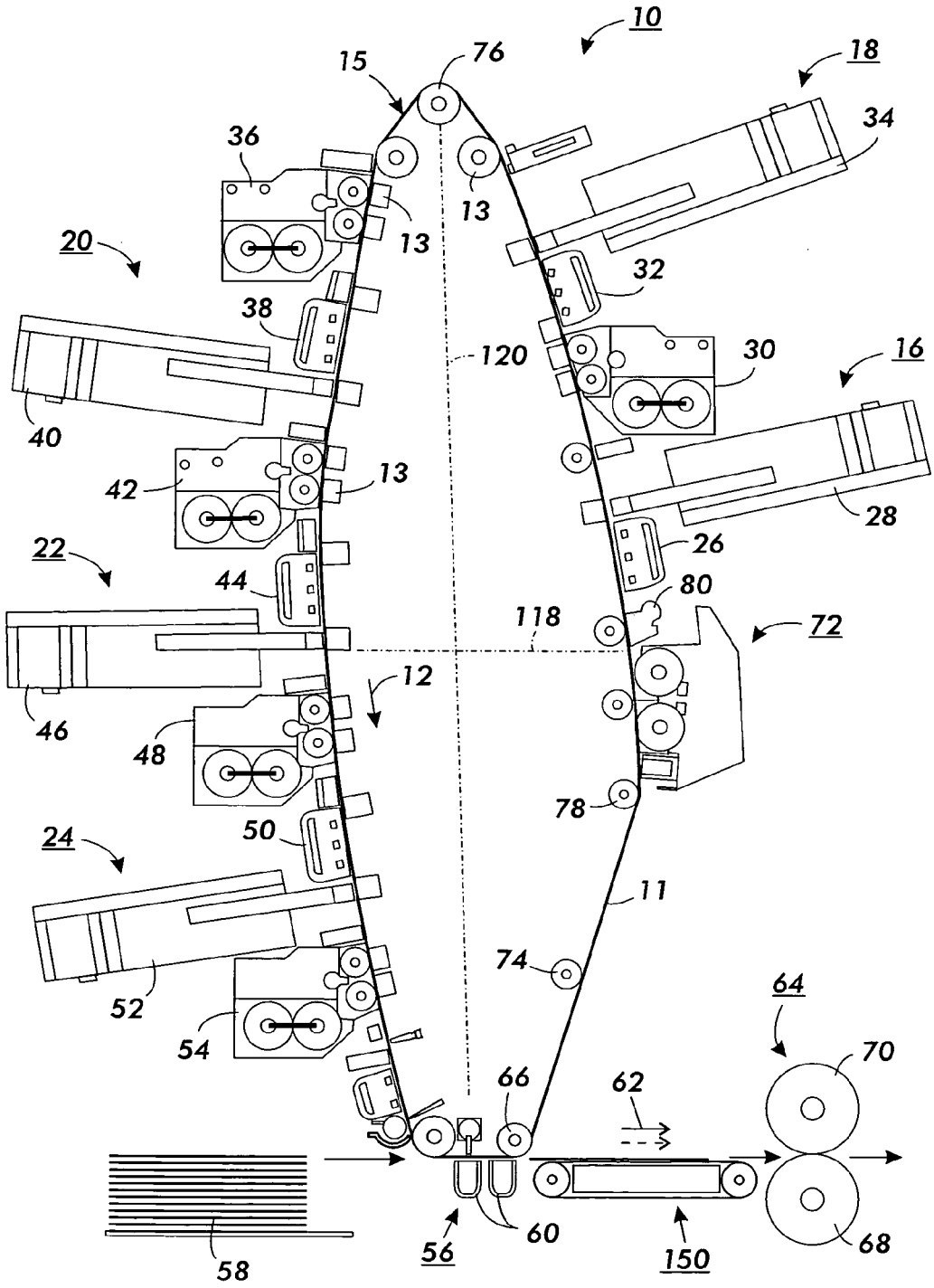
FIG. 1 is an elevational view of an illustrative printing machine incorporating the air diffusing vacuum transport assembly of the present invention.

With reference to FIG. 1, there is shown a single pass multi-color xerographic printing machine 10, for example, that employs a flimsy continuous photoconductive imaging belt 11 as is well known. For operation, the belt 11 is mounted onto and driven by a belt support and drive assembly or belt module 15 that includes a series of rollers or bars, 13. In operation of the single pass multi-color xerographic printing machine 10, the photoconductive belt 11 advances in the direction of arrow 12 to move successive portions of its external surface sequentially beneath the various xerographic processing stations disposed about the path of movement thereof within the printing machine 10. Initially, belt 11 passes through charging station 16 that includes a charging device such as a corona generator 26 that charges the exterior surface of photoconductive belt 11 to a relatively high, and substantially uniform potential.

After a portion of the exterior surface of photoconductive belt 11 is charged, that charged portion thereof advances to an exposure station that includes an exposure device such as a raster output scanner (ROS) 28. The ROS 28 image-wise illuminates the charged portion of the exterior surface of photoconductive belt 11 to record a first electrostatic latent image thereon. Alternatively, a light emitting diode (LED) may be used.

This first electrostatic latent image is developed at a development station by developer unit 30 that deposits charged toner particles of a selected first color on the first electrostatic latent image. After the toner image has been developed as such on the exterior surface of photoconductive belt 11, belt 11 continues to advance in the direction of arrow 12 to a recharging station 18.

Recharging station 18 includes a recharging device and an exposure device. The charging device for example is a corona generator 32 that recharges the exterior surface of photoconductive belt 11 to a relatively high, and substantially uniform potential. The exposure device, for example, a ROS 34, image-wise illuminates the charged portion of the exterior surface of photoconductive belt 11 selectively to record a second electrostatic latent image thereon. This second electrostatic latent image corresponds to the regions to be developed with for example with second color of toner particles. This second electrostatic latent image is now advanced to the next successive developer unit 36.

Developer unit 36 deposits the second color toner, for example magenta toner particles on the electrostatic latent image. In this way, a magenta toner powder image is formed on the exterior surface of photoconductive belt 11. After the magenta toner powder image has been developed on the exterior surface of photoconductive belt 11, photoconductive belt 11 continues to advance in the direction of arrow 12 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 11 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 11 to form a yellow toner powder image thereon. After the third electrostatic latent image has been developed with yellow toner, belt 11 advances in the direction of arrow 12 to the next image recording station 22.

Image recording station 22 includes a charging device and an exposure device. The charging device includes a corona generator 44, which charges the exterior surface of photoconductive belt 11 to a relatively high, substantially uniform potential. The exposure device includes ROS 46, which illuminates the charged portion of the exterior surface of photoconductive belt 11 to record a fourth electrostatic latent image for development with cyan toner particles. After the fourth electrostatic latent image is recorded on the exterior surface of photoconductive belt 11, photoconductive belt 11 advances this electrostatic latent image to the magenta developer unit 48.

Cyan developer unit 48 deposits magenta toner particles on the fourth electrostatic latent image. These toner particles may be partially in superimposed registration with the previously formed yellow powder image. After the cyan toner powder image is formed on the exterior surface of photoconductive belt 11, photoconductive belt 11 advances to the next image recording station 24.

Image recording station 24 includes a charging device and an exposure device. The charging device includes a corona generator 50 that charges the exterior surface of photoconductive belt 11 to a relatively high, substantially uniform potential. The exposure device includes ROS 54, which illuminates the charged portion of the exterior surface of photoconductive belt 11 to selectively discharge those portions of the charged exterior surface of photoconductive belt 11 which are to be developed with black toner particles. The fifth electrostatic latent image, to be developed with black toner particles, is advanced to black developer unit 54.

At black developer unit 54, black toner particles are deposited on the exterior surface of photoconductive belt 11. These black toner particles form a black toner powder image which may be partially or totally in superimposed registration with the previously formed yellow and magenta toner powder images. In this way, a multi-color toner powder image is formed on the exterior surface of photoconductive belt 11. Thereafter, photoconductive belt 11 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 11 to the sheet of paper. Stripping axis roller 66 contacts the interior surface of photoconductive belt 11 and provides a sufficiently sharp bend thereat so that the beam strength of the advancing paper strips from photoconductive belt 11.

The image carrying sheet of paper is then moved by the vacuum transport assembly 150 of the present invention (to be described in detail below) in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where with other sheets it is compiled and formed into sets that may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 11. The photoconductive belt 11 moves over isolation roller 78 that isolates the cleaning operation at cleaning station 72. At cleaning station 72, the residual toner particles are removed from photoconductive belt 11. The belt 11 then moves under spots blade 80 to also remove toner particles therefrom.

Figure 2:
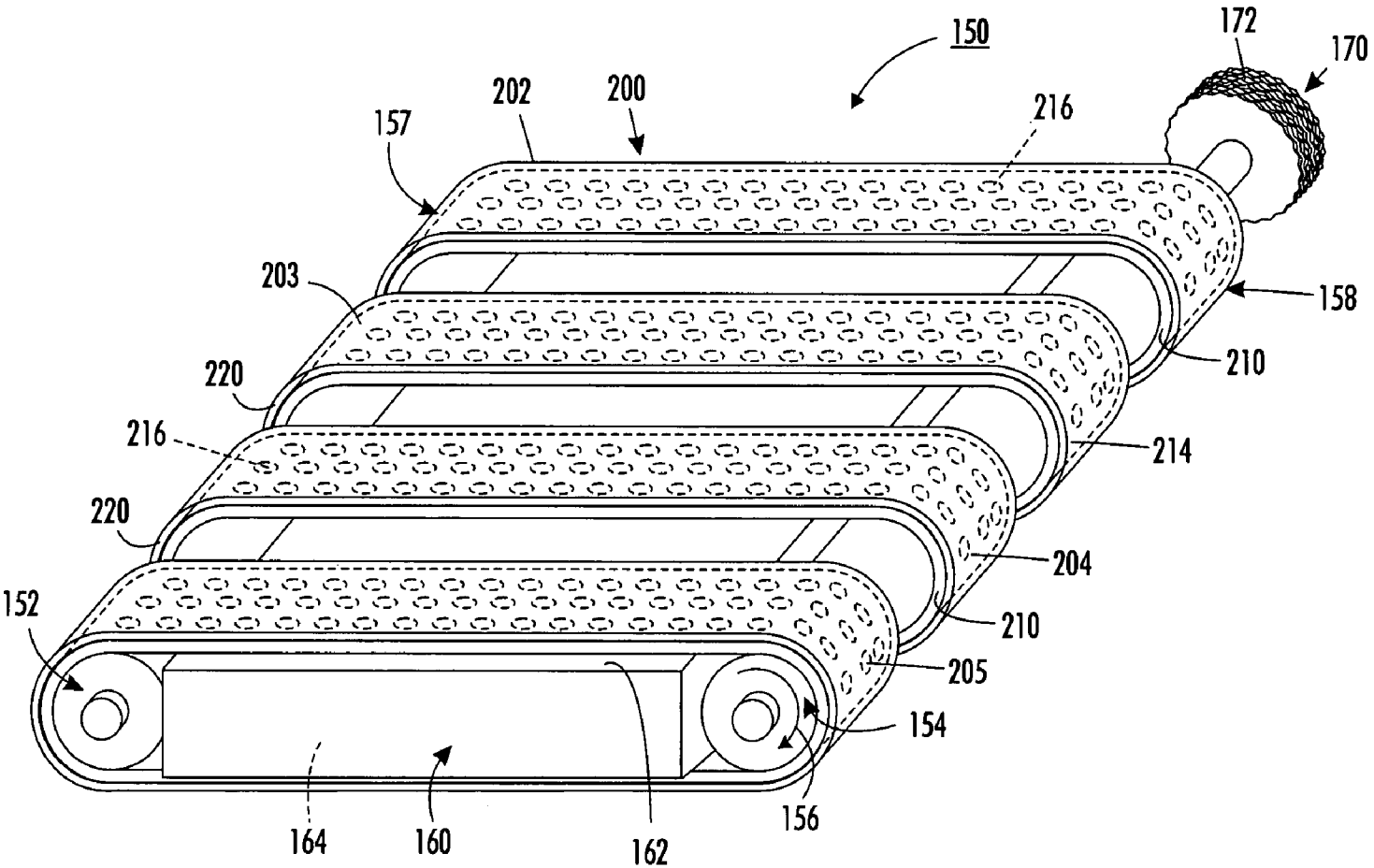
FIG. 2 is an isometric view of the air diffusing vacuum transport assembly shown in FIG. 1 showing plural air diffusing vacuum transport belts.
Figure 3:
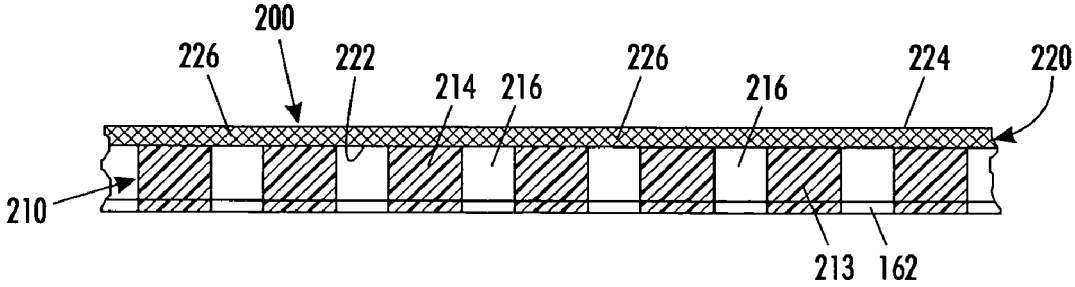
FIG. 3 is a cross sectional illustration of an air diffusing vacuum transport belt in accordance with the present invention.

Referring now to FIGS. 1–3, the air diffusing vacuum transport assembly 150, including the air diffusing vacuum transport belt 200 of the present invention, are illustrated in detail. As shown in FIG. 2, the air diffusing vacuum transport assembly 150 includes a set of air diffusing vacuum transport belts 202, 203, 204, 205 that are each entrained around roller assemblies 152, 154. Although FIG. 2 demonstrates an embodiment using multiple narrow belts 202, 203, 204, 205, another equally effective embodiment (not shown) can use a single, wide, full-width air diffusing vacuum transport belt 200. The roller assemblies 152 are mounted for rotation in the direction of arrow 156 in order to drive sheets from an entrance end 157 to an exit end 158 in the direction of fuser station 64. A vacuum plenum assembly 160 is situated inside the loop of air diffusing vacuum transport belts 202, 203, 204, 205 for applying vacuum pressure to the non-imaged or back side of copy sheets that have received images at transfer station 56. The vacuum plenum assembly 160 acts to attach the back side of individual copy sheets to the outer surface 224 of air diffusing vacuum transport belts 202, 203, 204, 205 as they are transported to the fuser.

As shown, the flat air diffusing vacuum transport belts 202, 203, 204, 205 are each moved along the top plate 162 of the vacuum plenum assembly 160 in the direction 62 towards the fuser 64. Apertures or slots (not shown) in the top plate 162 should be arranged such that the aperture area in the direction of travel of an air diffusing belt 202, 203, 204, 205 moving thereover is constant. This guarantees that the thermal signature applied therefrom to a sheet or paper as it travels across the vacuum plenum 160 has no gradient thereto. In other words, if the sheet were sliced into sections from front to rear, each section would be exposed to the same average thermal conditions traveling from entrance to exit across the vacuum transport assembly 150. Additionally, the vacuum transport assembly 150 may include tracking rollers (not shown) for reliably tracking the belts 202, 203, 204, 205 thereon, and a centrifugal blower (not shown), for example may be provided for evacuating the plenum chamber 164 below the belt surface.

Optionally, one embodiment of this assembly can contain, at the exit end 158 of the vacuum transport assembly 150, a sealed, fluid filled, heat pipe 170. The heat pipe 170 as such is provided for limiting the ultimate temperature of the belts 202, 203, 204, 205 by removing heat from the belts and carrying such heat away through cooling fins 172. The cooling fins 172 as shown are located at the back end of the heat pipe 170. Airflow in this area carries heat away to a duct system (not shown).

Referring in particular to FIGS. 2–3, each air diffusing vacuum transport belt 202, 203, 204, 205 includes a first perforated layer 210 for mounting over the vacuum plenum assembly 160. The first perforated layer 210 includes a top surface and a bottom surface, solid areas 214, and perforated hole areas 216 interspersing the solid areas for directing pressurized airflow from the top surface through to the bottom surface. Each air diffusing vacuum transport belt also includes a second non-perforated layer 220 formed over the top surface of the first perforated layer 210 and covering the solid areas 214 and the perforated hole areas 216. The second non-perforated layer 220 is suitable for transporting image carrying substrates across such plenum assembly 160 without vacuum belt induced image defects. The second non-perforated layer 220 has an inner surface 222 positioned over the top surface of the first perforated layer 210, and an outer surface 224 for uniformly supporting substrates. As shown in FIG. 3, the second non-perforated layer 220 may be laminated onto the top surface of the first perforated layer 210. The second non-perforated layer 220 as such is made for example of a selected material having a density significantly less than a density of the first perforated layer 210. The selected material for the second layer 220, relative to the first perforated layer 210, may be less thermally conductive. The second non-perforated layer 220 as such is also porous to air for diffusing pressurized airflow from the outer surface thereof into the perforated hole areas 216 of the first perforated layer 210, thereby enabling transporting of image carrying substrates without vacuum belt induced image defects.

Thus each air diffusing vacuum transport belt can be made of a one piece woven, low density, electrically non-conductive material, capable of sustaining temperatures up to 260° C. The woven or outer surface 224 enables uniform airflow through openings 226 therein that are fine enough to prevent temperature related gloss artifacts, yet large and numerous enough to maintain control of the sheet. Accordingly, the outer surface 224 of the second non-perforated layer 220 would be smooth for providing a uniform support surface for a back side of an image carrying substrate.

Additionally, the outer surface 224 of the top or second layer 220 as a fabric layer, would present airflow to the media or image carrying sheet in a diffused or distributed manner so that the airflow does not create a dramatic temperature gradient over the belt surface. For the embodiment using multiple belts 202, 203, 204, 205, the thickness of the top, second layer will also raise the media above the hole areas 216 of the perforated layer 210, thereby reducing exposure to the ordinary temperature variations seen between the belts on a metal surface. A single full-width belt 200 allows no exposure to the underlying transport surface. These advantages of the present invention are important because in commercial digital color printing, the problem of gloss differential will always be present as an image artifact that will be unacceptable to the customer.

As can be seen, there has been provided an air diffusing vacuum transport belt including a first perforated layer and a second non-perforated layer for transporting image carrying substrates without vacuum belt induced image defects. The first perforated layer includes a top surface and a bottom surface, solid areas, and perforated hole areas interspersing the solid areas for directing pressurized airflow from the top surface through to the bottom surface. The air diffusing vacuum transport belt also includes a second non-perforated layer formed over the top surface of the first perforated layer and covering the solid areas and the perforated hole areas. The second non-perforated layer has an inner surface positioned over the top surface of the first perforated layer, and an outer surface for uniformly supporting substrates. The second non-perforated layer as such is porous to air for diffusing pressurized airflow from the outer surface thereof into the perforated hole areas of the first perforated layer, thereby enabling transporting of image carrying substrates without vacuum belt induced image defects.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An air diffusing vacuum transport assembly in an image reproducing machine comprising:

(a) a vacuum plenum assembly including a vacuum chamber;

(b) belt support means for supporting a movable continuous belt around said vacuum plenum assembly, said belt support means including a heat pipe, and said heat pipe comprising a roller and a heat conductive fluid sealed therein; and (c) an air diffusing vacuum transport belt mounted around said vacuum plenum assembly for supporting and transporting a substrate over said vacuum plenum assembly, said air diffusing vacuum transport belt including:

(i) a first perforated layer for mounting over said vacuum plenum assembly, said first perforated layer including a top surface and a bottom surface, solid areas, and perforated hole areas interspersing said solid areas for directing pressurized airflow from said top surface through to said bottom surface; and (ii) a second non-perforated layer formed over said top surface of said first perforated layer and covering said solid areas and said perforated hole areas, said second non-perforated layer having an inner surface positioned over said top surface of said first perforated layer, and an outer surface for uniformly supporting substrates, and said second non-perforated layer being porous to air for diffusing pressurized airflow from said outer surface thereof into said perforated hole areas of said first perforated layer, thereby enabling transporting of image carrying substrates without vacuum belt induced image defects.

2. The air diffusing vacuum transport assembly of claim 1, wherein said vacuum plenum assembly includes a top plate having airflow apertures located below said air diffusing vacuum transport belt.

3. The air diffusing vacuum transport assembly of claim 1, wherein said heat pipe includes cooling fins for dissipating heat from said heat pipe.

4. An image producing machine comprising:

(a) a belt module including a belt support means for supporting a moveable continuous belt around a vacuum plenum assembly, said belt support means including a heat pipe, and said heat pipe comprising a roller and a heat conductive fluid sealed therein;

(b) sheet feeders for supplying and moving an image receiving sheet through said belt module;

(c) imaging means including toner for forming an image on said image receiving sheet; and (d) an air diffusing vacuum transport assembly for transporting said image receiving sheet within said belt module, said air diffusing vacuum transport assembly including an air diffusing vacuum transport belt for supporting and transporting a sheet, said air diffusing vacuum transport belt including:

(i) a first perforated layer for mounting over a vacuum plenum, said first perforated layer including a top surface and a bottom surface, solid areas, and perforated hole areas interspersing said solid areas for directing pressurized airflow from said top surface through to said bottom surface; and (ii) a second non-perforated layer formed over said top surface of said first perforated layer and covering said solid areas and said perforated hole areas, said second non-perforated layer having an inner surface positioned over said top surface of said first perforated layer, and an outer surface for uniformly supporting sheets and said second non-perforated layer being made of a selected electrically non-conductive material having a density that is less than a density of said first layer, and being porous to air for diffusing pressurized airflow from said outer surface thereof into said perforated hole areas of said first perforated layer, thereby enabling transporting of image carrying sheets without vacuum belt induced image defects.

5. The image producing machine of claim 4, wherein said heat pipe includes cooling fins for dissipating heat from said heat pipe.

6. The air diffusing vacuum transport assembly air diffusing vacuum transport belt of claim 1, wherein said first perforated layer is made of an elastomeric material.

7. The air diffusing vacuum transport assembly of claim 1, including tracking rollers for maintaining tracking of said air diffusing vacuum transport belt on a frame defining the vacuum plenum assembly.

8. The air diffusing vacuum transport assembly of claim 1, wherein said second non-perforated layer of said air diffusing vacuum transport belt is laminated onto said top surface of said first perforated layer.

9. The air diffusing vacuum transport assembly of claim 1, wherein said second non-perforated layer of said air diffusing vacuum transport belt is made of a selected material having a density significantly less than a density of said first perforated layer.

10. The air diffusing vacuum transport assembly of claim 1, wherein said outer surface of said second non-perforated layer of said air diffusing vacuum transport belt is smooth for providing a uniform support surface for a back side of an image carrying sheet.

11. The air diffusing vacuum transport assembly of claim 1, wherein said second non-perforated layer of said air diffusing vacuum transport belt is made of a woven fabric material.

12. The air diffusing vacuum transport assembly of claim 9, wherein said selected material is electrically non-conductive.

13. The air diffusing vacuum transport assembly of claim 9, wherein said selected material, relative to said first perforated layer, is less thermally conductive.

* * * * *